US008391538B2

(12) United States Patent
Chiu et al.

(10) Patent No.: US 8,391,538 B2
(45) Date of Patent: Mar. 5, 2013

(54) EARPHONE

(75) Inventors: Chun-Ching Chiu, Taipei (TW); Mu-Tsun Tseng, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 240 days.

(21) Appl. No.: 12/973,876

(22) Filed: Dec. 20, 2010

(65) Prior Publication Data

US 2012/0155690 A1 Jun. 21, 2012

(51) Int. Cl.
*H04R 1/00* (2006.01)

(52) U.S. Cl. ..... 381/409; 381/394

(58) Field of Classification Search ..... 381/394, 381/409

See application file for complete search history.

(56) References Cited

U.S. PATENT DOCUMENTS

| | | | | |
|---|---|---|---|---|
| 4,376,233 | A * | 3/1983 | Kamon et al. | 381/409 |
| 4,520,237 | A * | 5/1985 | Murakami | 381/412 |
| 6,023,518 | A * | 2/2000 | Kuwabara et al. | 381/396 |
| 6,175,637 | B1 * | 1/2001 | Fujihira et al. | 381/412 |
| 6,385,328 | B1 * | 5/2002 | Yoo et al. | 381/412 |
| 6,842,530 | B2 * | 1/2005 | Fukazawa et al. | 381/409 |
| 8,155,374 | B2 * | 4/2012 | Yuasa et al. | 381/412 |
| 2008/0298629 | A1 * | 12/2008 | Huang et al. | 381/398 |

* cited by examiner

*Primary Examiner* — Curtis Kuntz
*Assistant Examiner* — Ryan Robinson
(74) *Attorney, Agent, or Firm* — Lin & Associates IP, Inc.

(57) ABSTRACT

An earphone includes a basket defining a through hole. A leading wire board fixed underneath the basket has a pair of solder foils on a bottom surface thereof. A magnet unit is located in the basket with the through hole adjacent to a side edge of the magnet unit. A diaphragm is arranged on the basket and over the magnet unit. A voice coil is fixed to a bottom of the diaphragm and surrounding the magnet unit. The voice coil has two leading wires. Each leading wire passes through the through hole of the basket and further bends to solder with the corresponding solder foils of the leading wire board.

2 Claims, 4 Drawing Sheets

EARPHONE

BACKGROUND OF THE INVENTION

1. Field of the Invention

The present invention relates to an earphone, and particularly to an earphone which can reduce the noise produced by lead wires.

2. The Related Art

Referring to FIG. 5, a traditional earphone 400 comprises a diaphragm 410, a voice coil 420 for driving the diaphragm 410, a magnet 430 wrapped by the voice coil 420 for producing a magnetic flux in the vicinity of the voice coil 420, and a basket 450. The diaphragm 410, the voice coil 420 and the magnet 430 are arranged in the basket 450. A leading wire 421 of the voice coil 420 is glued on the back of the diaphragm 410, for avoiding the leading wire 421 affecting the diaphragm 410 while the diaphragm 410 is working.

After the traditional earphone 400 works over a long time, the leading wire 421 may be apart from the diaphragm 410 and hit the diaphragm 410, and cause the diaphragm 410 to make noise. This way of the leading wire 421 being glued to the diaphragm 410 increases the associated process of the traditional earphone 400.

SUMMARY OF THE INVENTION

Accordingly, an object of the present invention is to provide an earphone. The earphone includes a basket defining a through hole. A leading wire board fixed underneath the basket has two solder foils on a bottom surface thereof. A magnet unit is located in the basket with the through hole adjacent to a side edge of the magnet unit. A diaphragm is arranged on the basket and over the magnet unit. A voice coil is fixed to a bottom of the diaphragm and surrounding the magnet unit. The voice coil has two leading wires. Each leading wire passes through the through hole of the basket and further bends to solder with the corresponding solder foils of the leading wire board.

As described above, the leading wires of the voice coil extend downward from the bottom of the voice coil, and downward pass through the though hole of the bottom board of the basket and the aperture of the leading wire board, and then bend toward the two sides for being soldered with the corresponding solder foils. Therefore, the leading wire need not to be fixed on the diaphragm as shown in the prior art, then the load of the diaphragm is eliminated. Meanwhile, the noise produced by the leading wire hitting the diaphragm when falling off the diaphragm is avoided.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
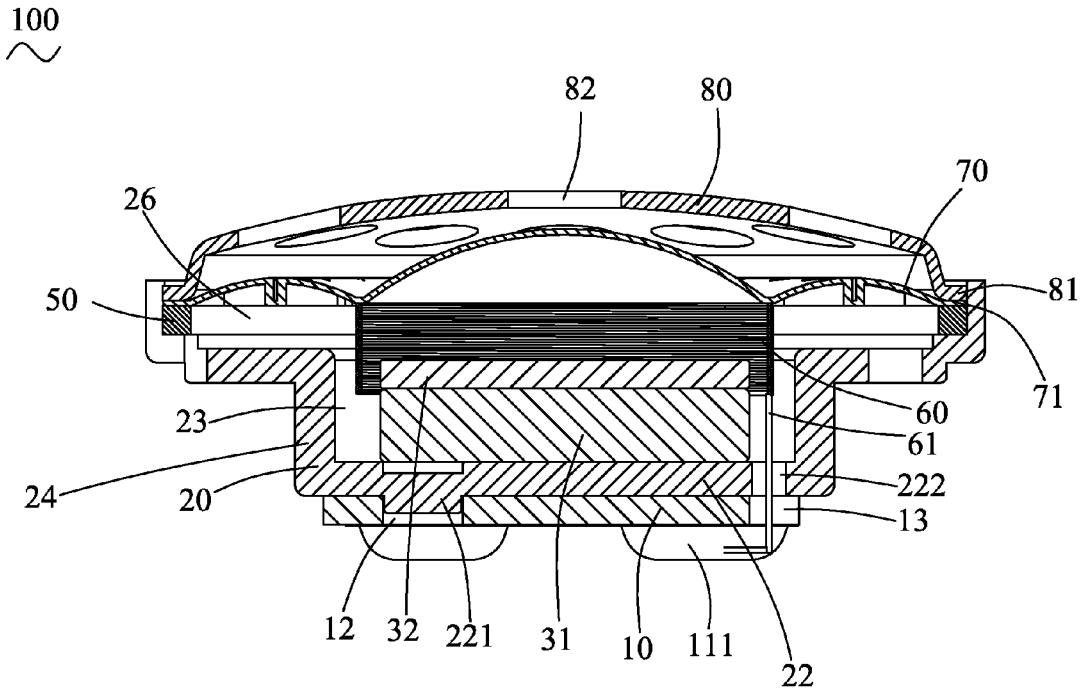
FIG. 1 is a cross-sectional view of an earphone according to the present invention.
Figure 2:
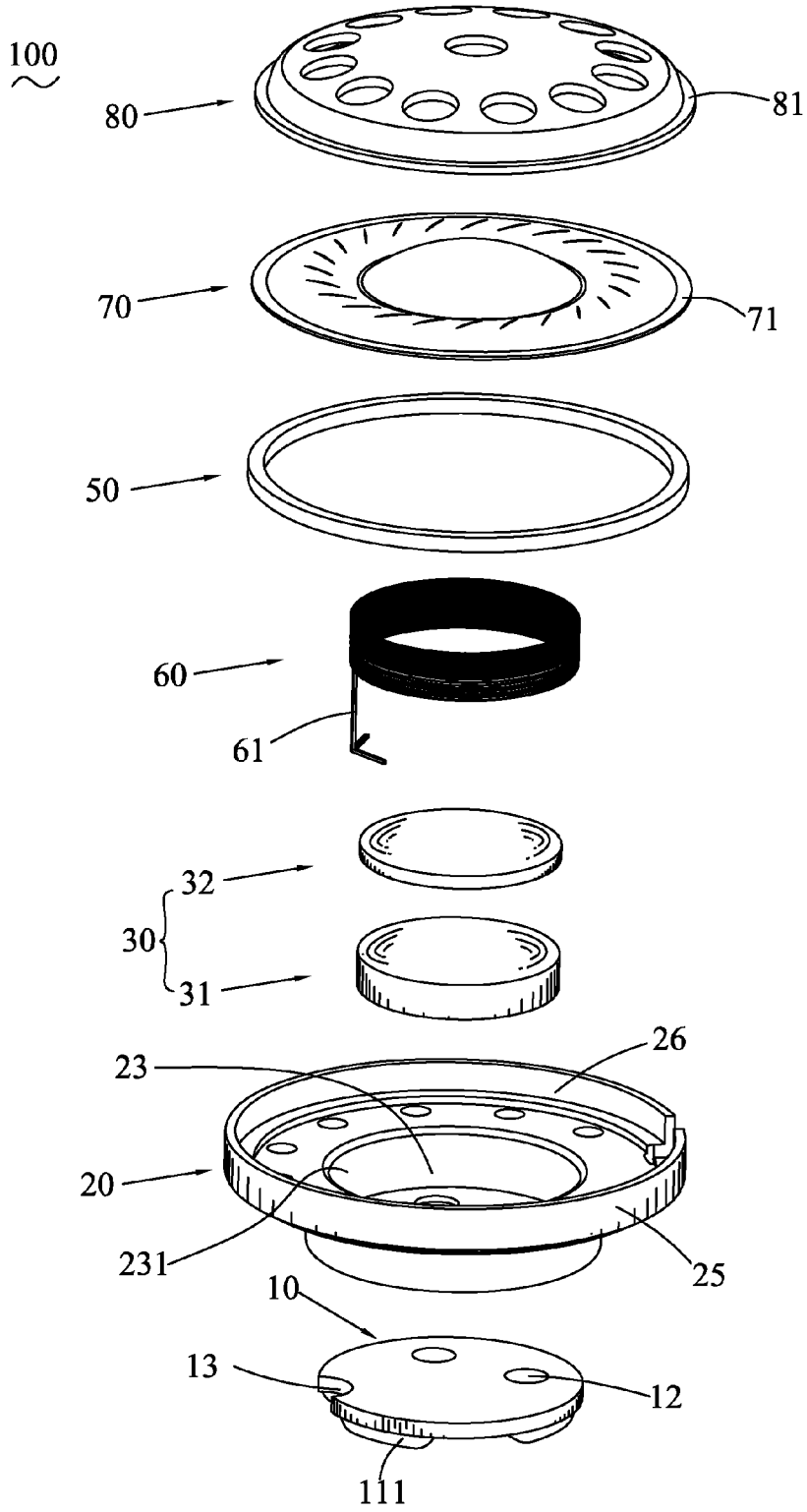
FIG. 2 is an exploded, perspective view of the earphone of FIG. 1.

Referring to the drawings in greater detail, and first to FIGS. 1-2, the embodiment of the invention is embodied in an earphone 100. The earphone 100 comprises a leading wire board 10, a basket 20, a magnet unit 30, a pad ring 50, a voice coil 60, a diaphragm 70 and a shield 80.

Figure 3:
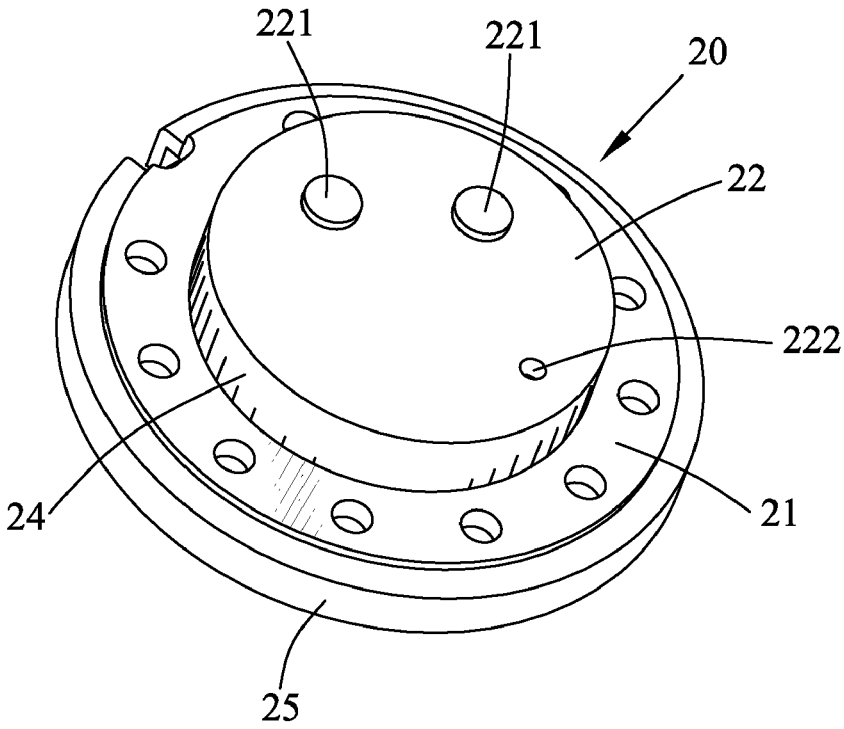
FIG. 3 is a perspective view of a basket of the earphone.

Referring to FIGS. 1-3, the basket 20 has a disc-shaped main body 21 for receiving the diaphragm 70. A center of the main body 21 defines an opening 231. A periphery of the opening 231 extends downward to form an annular side wall 24. A bottom board 22 connects with a bottom of the annular side wall to collectively define a receiving room 23 for receiving the magnet unit 30 therein. A side edge of the main body 21 extends upward to form a propping wall 25. The propping wall 25 and the main body 21 collectively define a receiving cavity 26 communicating with the receiving room 23. Both the receiving cavity 26 and the receiving room 23 are cylinder-shaped and the diameter of the receiving cavity 26 is bigger than the diameter of the receiving room 23. The bottom board 22 defines a though hole 222 adjacent to the annular side wall 24. A pair of column lumps 221 is formed on a bottom surface of the bottom board 22 and spaces away from the though hole 222.

Figure 4:
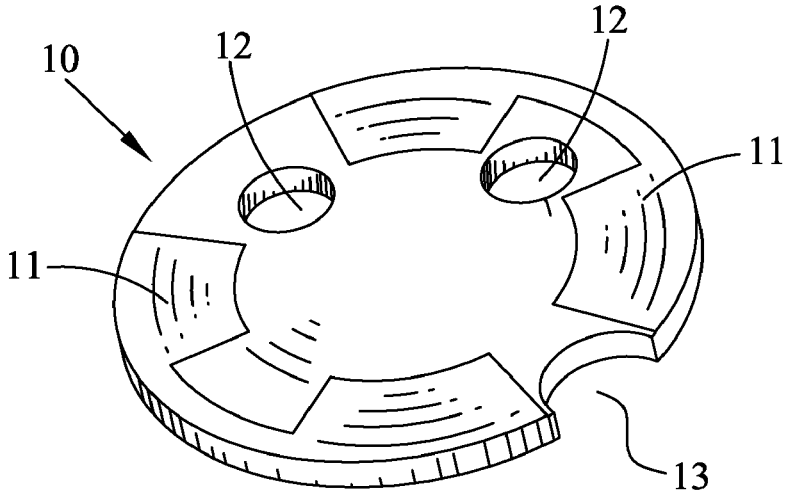
FIG. 4 is a perspective view of a leading wire board of the earphone.
Figure 5:
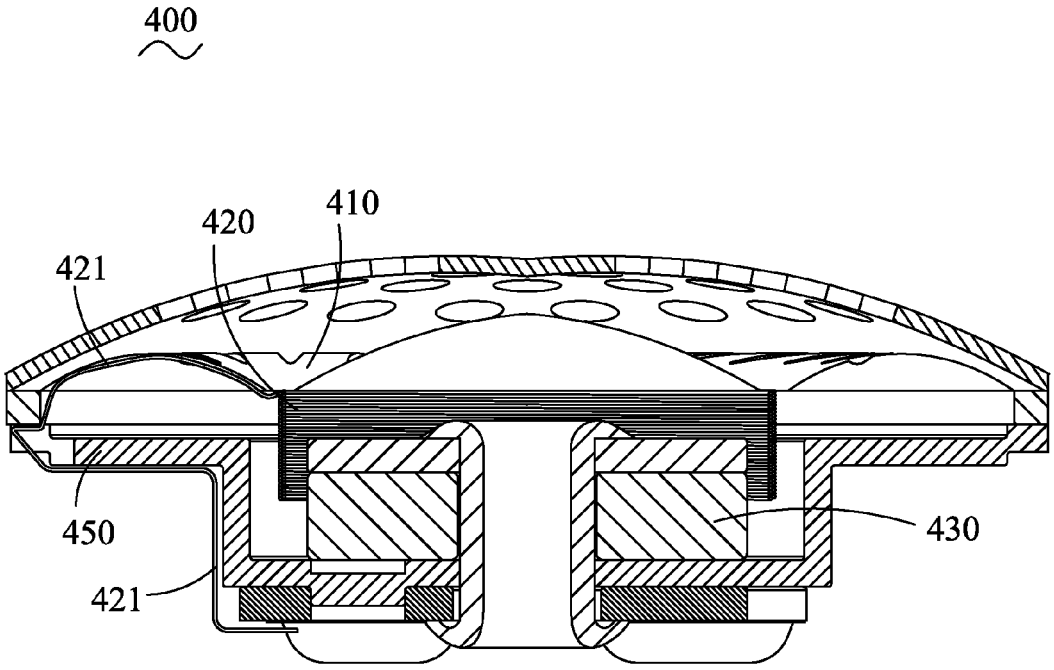
FIG. 5 is a cross-sectional view of a traditional earphone.

Referring to FIG. 2 and FIG. 4, the leading wire board 10 is fixed underneath the basket 20. The leading wire board 10 is circular-shaped and defines a substantially semicircular aperture 13 at a side edge thereof and two locating openings 12 corresponding to the column lumps 221. The aperture 13 of the leading wire board 10 corresponds to the though hole 222 of the basket 20 when the leading wire board 10 is fixed on the bottom surface of the bottom board 22. A pair of solder foils 11 is attached on a bottom surface of the leading wire board 10. The locating openings 12 engage with the column lumps 221, so the leading wire board 10 and the basket 20 can fix together.

Referring to FIG. 2, the magnet unit 30 includes a cylinder-shaped magnet 31 and a cylinder-shaped magnetic conduction plate 32 attached on the magnet 31. The diameter of the magnet 30 approximately equals the diameter of the magnetic conduction plate 32. Both the diameter of the magnet 31 and the diameter of the magnetic conduction plate 32 are smaller than the diameter of the receiving room 23. The magnet unit 30 is located in the receiving room 23 of the basket 20, with the though hole 222 adjacent to a side edge of the magnet unit 30.

Referring to FIG. 2 again, the pad ring 50 is restrained in the receiving cavity 26. In the embodiment, the pad ring 50 is glued on a top surface of the main body 21 of the basket 20 and an outer surface of the pad ring 50 is glued on an inside surface of the propping wall 25. The diaphragm 70 has an exterior rim 71. The exterior rim 71 of the diaphragm 70 is glued on the pad ring 50 and an outer edge of the exterior rim 71 is glued on the inside surface of the propping wall 25 for attaining the purpose of constraining the diaphragm 70 in the receiving room 26.

Referring to FIG. 1 and FIG. 2, a long wire is coiled to form the voice coil 60 which has a cylinder shape. The voice coil 60 has two leading wires 61. The two leading wires 61 respectively extend downward from a bottom of the voice coil 60. The voice coil 60 is fixed to a bottom of the diaphragm 70 and surrounds the magnet unit 30. Each leading wire 61 of the voice coil 60 downward passes through the though hole 222 of the bottom board 22 of the basket 20 and the aperture 13 of the leading wire board 10 and then further bends to solder with the corresponding solder foils 11 by soldering tins 111.

Referring to FIG. 2, the shield 80 has a gluing rim 81. The gluing rim 81 is glued on the exterior rim 71 of the diaphragm 70 and an outer edge of the gluing rim 81 is glued on the inside surface of the propping wall 25 for attaining the purpose of fixedly assembling the shield 80 with the receiving cavity 26.

The shield 80 has lots of air holes 82. The air holes 82 are used to conduct the voice from the earphone 100 to the outside.

While the audio signal is transmitted to the voice coil 60 by the leading wires 61, the voice coil 60 vibrates up and down under the influence of the magnetic field. The voice coil 60 drives the diaphragm 70, so the diaphragm 70 shakes and makes voice. The voice passes through the air holes 82 to the outside. The length of the leading wire 61 approximately equals the distance from the solder foils 11 to the bottom of the voice coil 60.

As described above, the leading wires 61 of the voice coil 60 extend downward from the bottom of the voice coil 60, and downward pass through the though hole 222 of the bottom board 22 of the basket 20 and the aperture 13 of the leading wire board 10, and then bend to solder with the corresponding solder foils 11. Therefore, the leading wire 61 need not to be fixed on the diaphragm 70 as shown in the prior art, then the load of the diaphragm 70 is eliminated. Meanwhile, the noise produced by the leading wire 61 hitting the diaphragm 70 when falling off the diaphragm 70 is avoided.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An earphone, comprising:

a basket having a main body with a center of the main body defining an opening and a periphery of the opening extended downward to form an annular side wall, and a bottom board connecting with a bottom of the annular side wall to collectively define a receiving room, a portion of the bottom board adjacent to the annular side wall defining a through hole;

a leading wire board fixed underneath the bottom board of the basket having a pair of solder foils on a bottom surface thereof and an aperture defined in a side edge of the leading wire board corresponding to the through hole of the basket;

a magnet unit located in the basket and received in the receiving room with the through hole of the basket adjacent to a side edge of the magnet unit;

a diaphragm received by the main body of the basket over the magnet unit; and a voice coil fixed to a bottom of the diaphragm and surrounding the magnet unit, the voice coil having two leading wires corresponding to the two solder foils, each leading wire passing through the through hole of the basket and the aperture of the leading wire board and further being bent to solder with the corresponding solder foil of the leading wire board.

2. The earphone claimed in claim 1, wherein the magnet unit includes a magnet and a magnetic conduction plate attached on the magnet.

* * * * *